US005761770A

United States Patent [19]

Locatelli et al.

[11] Patent Number: 5,761,770

[45] Date of Patent: Jun. 9, 1998

[54] SLIDING FLAT FOR CARDING DEVICES AND A GUIDING AND DRIVE SYSTEM THEREFOR

[75] Inventors: Claudio Locatelli; Silvano Patelli; Antonio Cossandi, all of Palazzolo Sull'Oglio, Italy

[73] Assignee: Fratelli Marzoli & C. S.p.A., Bergamo, Italy

[21] Appl. No.: 504,475

[22] Filed: Jul. 20, 1995

[30] Foreign Application Priority Data

Jul. 22, 1994 [IT] Italy ..... MI94A1557

[51] Int. Cl.[6] ..... G01B 15/00

[52] U.S. Cl. ..... 19/102; 19/111

[58] Field of Search ..... 19/98, 99, 102, 19/103, 110, 111, 113

[56] References Cited

U.S. PATENT DOCUMENTS

| | | | |
|---|---|---|---|
| 4,955,111 | 9/1990 | Jagst | 19/102 |
| 4,987,647 | 1/1991 | Von Gehlen | 19/111 |
| 5,271,125 | 12/1993 | Leifeld et al. | 19/103 |
| 5,473,795 | 12/1995 | Spix et al. | 19/113 |
| 5,542,154 | 8/1996 | Demuth et al. | 19/113 |

FOREIGN PATENT DOCUMENTS

| | | |
|---|---|---|
| 0567747 | 3/1993 | European Pat. Off. . |
| 2403402 | 9/1978 | France . |
| 2674262 | 3/1992 | France . |
| 48569 | 2/1889 | Germany . |
| 609287 | 6/1933 | Germany . |

*Primary Examiner*—Michael A. Neas
*Attorney, Agent, or Firm*—Diller, Ramik & Wight, PC

[57] ABSTRACT

A carding flat and a system for guiding and driving it in a card with moving flats driven by articulated chains, in which coupling between the flats and chains is achieved by a form fit using recesses and projections without fixed retention devices, so that these elements are not mutually constrained in the direction perpendicular to the chain movement.

13 Claims, 9 Drawing Sheets

SLIDING FLAT FOR CARDING DEVICES AND A GUIDING AND DRIVE SYSTEM THEREFOR

BACKGROUND OF THE INVENTION

This invention relates to cards with sliding flats in which fibrous material in thin layer form is worked by a series of surfaces provided with a plurality of points of various shape, inclination and rigidity and driven to move relative to each other, in which the fibrous material is opened into single fibre form, the small trash particles being eliminated together with waste and tangles, the fibres undergoing mutual mixing to form a sliver of untwisted fibres to be fed to the subsequent working stages.

To highlight the technical problems involved in carding and confronted by the present invention, the flat carding process is described briefly with reference to the scheme of FIG. 1. The raw material 1 consisting of staple fibres collected into the form of a web of approximately rectangular cross-section is fed to the machine by a feed roller 2 which presses and controls it against the board 3 to feed a strip 4 to the opening cylinder 5. This cylinder is provided with clothing, ie points inclined in its direction of rotation, and is driven at a considerable rotational speed. The fibre strip 4 is hence roughly combed and distributed over the opening cylinder into a layer thinner than the original layer 1. During its anticlockwise rotation the fibre layer encounters clothed segments and blades for removing impurities, after which the fibres pass to the subsequent carding drum 6. The drum 6 is driven at a rotational speed less than the cylinder 5, but as it has a much larger diameter its peripheral speed is higher. The points on the drum 6 are also inclined in the direction of movement, to remove the fibres from the surface of the cylinder 5 along the closest generating lines between 5 and 6. The so-called moving flats 7 are located above the top of the drum 6. Generally, flat cards are also provided with fixed flats, however these do not concern the present invention and hence reference will not be made thereto in the present description. The moving flats are in the form of bars having a useful length corresponding to the generating line of the carding drum 6 and a few centimeters in width. That part thereof which faces the drum 6 is provided with clothing in the form of points pointing in the direction of movement. Generally the moving flats move slowly in a direction of rotation which is the same as or opposite to the that of the drum. The two clothes cooperate with typical carding action to provide fibre extension, cleaning, retention and depth control within the point clothing. For some processes it may be required to rotate the flats in the opposite direction to the drum 6. It should however be noted that the peripheral drum speed is generally within the range of 15–40 meters per second, whereas the flat speed is of the order of a few millimeters per second. By rotating in the same direction as the drum, the flats 7 circulate in the opposite direction to the drum, conveyed by an articulated chain 8 circulating about a series of drive and guide sprockets 9. Along the carding path between the drum and flats, the flats are guided by guides 10 which precisely control the distance between the drum clothing and the flat clothing, this being the main factor in the good outcome of the operation. The guides 10 are positioned at the edge of the flat faces of the drum, and on them there slide the end parts, without points, of the flats 7. The extended and cleaned fibres become arranged into a thin layer on the carding drum 6.

They are then detached by a discharge cylinder 11, also provided with points inclined in the direction of rotation, to enable the fibres carded by the drum 6 to be withdrawn and then discharged from the cylinder 11 by detachment cylinders not shown in the figure.

The present invention relates in particular to an improved sliding flat for said flat cards and a system for guiding and driving it. In the known art the flats are generally driven by drive chains 8 to which the flats are fixed by bushes, brackets and various supports, either on the chain joints or plates, by screw elements, by snap rings or equivalent means. German patent application DE-A-3814412 describes various connections using lead-ins, clips and locking keys.

This type of connection is unsatisfactory because of its constructional and maintenance complexity and cost. It must also be noted that an articulated chain formed from rollers and plates represents a polygonal articulated element which is required to guide the flats along curved surfaces, and cannot always ensure the necessary clearance accuracy between the clothing. U.S. Pat. No. 4,757,575 describes adjustments for this clearance within one tenth of a millimeter and even narrower guide tolerances.

To obviate the typical drawbacks of articulated chains, German patent DE-A-3907396 describes a drive and guide system for flats using toothed belts to which the flats are coupled by various form fits without locking the flats with rigid fixing elements such as nuts and bolts. The system has however the typical drawbacks of toothed belts for this type of service.

SUMMARY OF THE INVENTION

The object of the invention is to provide an improved flat for said flat cards, and a system for guiding and driving it which uses an articulated chain drive but without the stated drawbacks of this type of drive when used in systems of the known art. According to the present invention, coupling between the flat and articulated chain is provided only in the direction of movement of the flats and in the direction along the drum generating line, while leaving said elements not coupled together in the direction perpendicular to the chain movement, by means of a form fit between the flats and chain using recesses and projections of mutually consistent shape, without fixed means for retaining them in position.

With the above and other objects in view that will hereinafter appear, the nature of the invention will be more clearly understood by reference to the following detailed description, the appended claims and the several views illustrated in the accompanying drawings.

Figure 1:
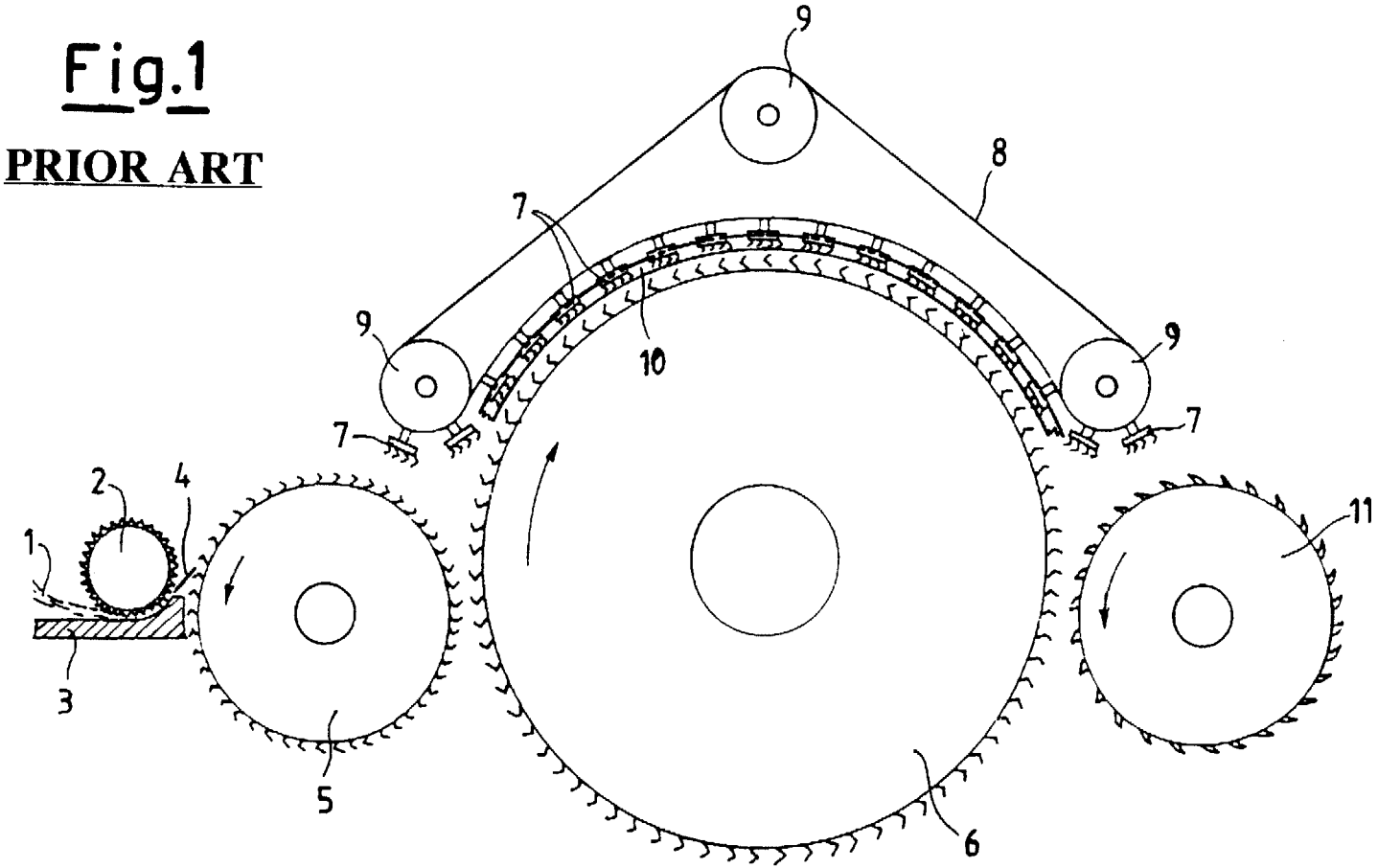
Fig.1 PRIOR ART
FIG. 1 is a schematic side elevational view of a conventional carding device, and illustrates raw material being fed by an opening cylinder to a carding drum over an upper portion of which flat cards are moved by drive chains.
Figure 2A:
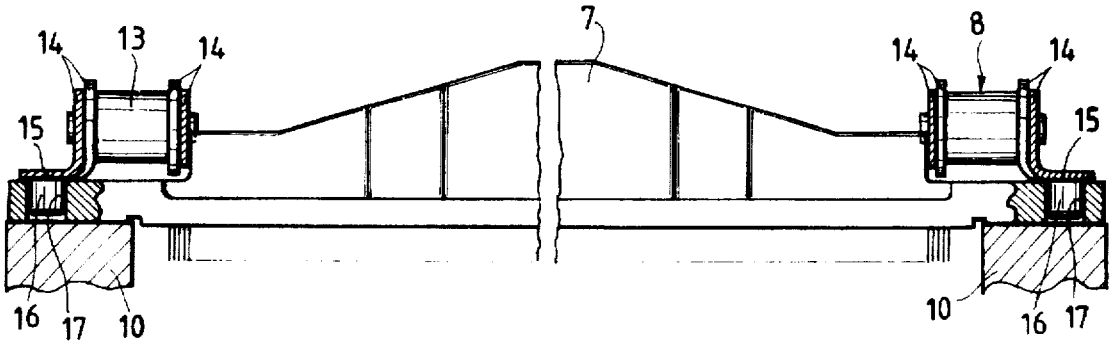
FIG. 2*a* is a fragmentary transverse view with parts broken away for clarity through a first embodiment of a flat/chain system of the invention, and illustrates chains carrying pegs which are received in openings at opposite ends of a flat.

Reference is first made to FIGS. 2*a*, *b*, *c* of the drawings which show a flat/chain system according to the first embodiment of invention. The flat 7 is preferably of T cross-section to provide sufficient rigidity against flexural stress between the two guide supports 10, which are spaced apart transversely by a distance of the order of one meter or slightly more. Their lower face, on the part 12 not involved with the guides 10, carries the card clothing indicated roughly as a series of points in FIG. 2 onwards. The articulated chain 8 consists essentially of pins 13 and plates 14. Those plates 14 which face outwards are provided with an L-bent piece 15 for engaging the flat 7. On the lower part of the L-bent piece 15 there is positioned a peg 16, which can be conical or cylindrical, to engage in a likewise conical or cylindrical hole 17 provided in the most outer part of the flat 7. This hole can be a through or non-through hole. As can be seen, the guiding precision between the chain and flat corresponds to the accuracy of the fit between the hole and peg. Along that part of the path in which it rests on the guide 10 the flat 7 faithfully follows the guide 10 under the drive of the chain 8, because it is not constrained to the chain radially and is therefore substantially indifferent to its joints.

Figure 2B:
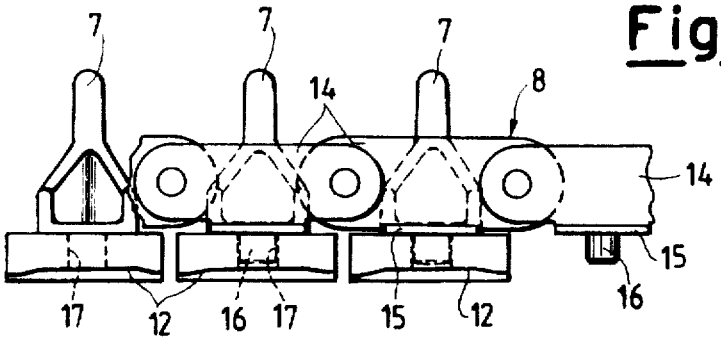
FIG. 2*b* is a fragmentary side elevational view of the flat/chain system of FIG. 2*a*, and illustrates the manner in which the pegs carried by one of the pegs is telescopically received in the openings of a plurality of the flats.
Figure 2C:
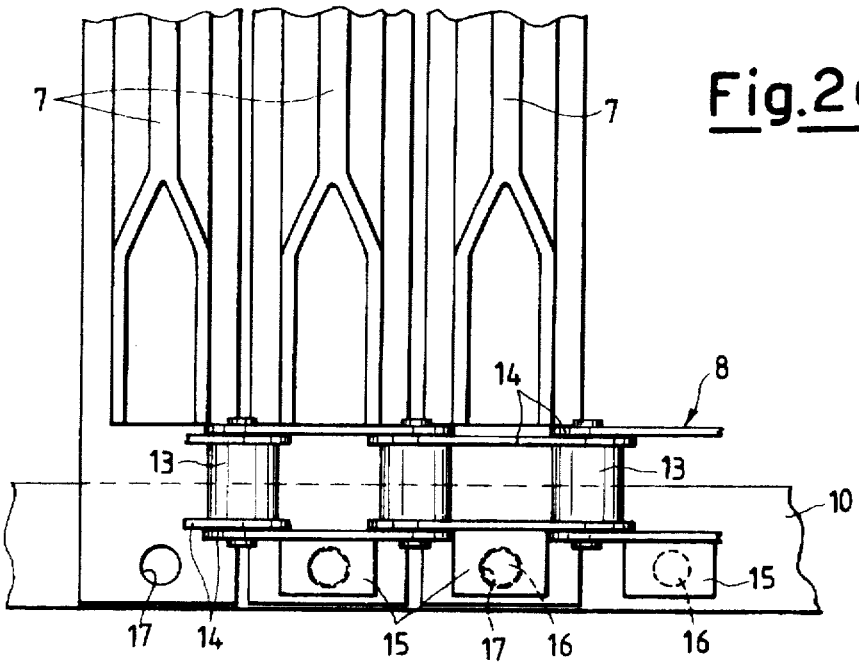
FIG. 2*c* is a fragmentary top elevational view, and illustrates further details of the flats, one of the chains and the pegs carried thereby.
Figure 3A:
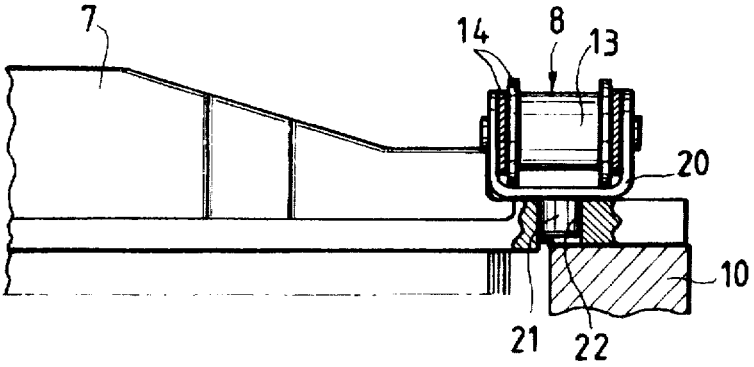
FIG. 3*a* transverse fragmentary view taken through another flat/chin system of the invention, and illustrates a chain carrying a upwardly opening U-shaped bracket and an associated peg received in an opening of a flat.

FIGS. 3*a*, *b*, *c* show an alternative embodiment in which with each pin 13 of the articulated chain 8 there is associated a U-shaped element 20 which carries on its lower part a peg 21 perpendicular to the axis of the pin 13, to engage a hole 22 provided in the most outer part of the flat 7. Functions and shapes are analogous to those of FIG. 2.

Figure 3B:
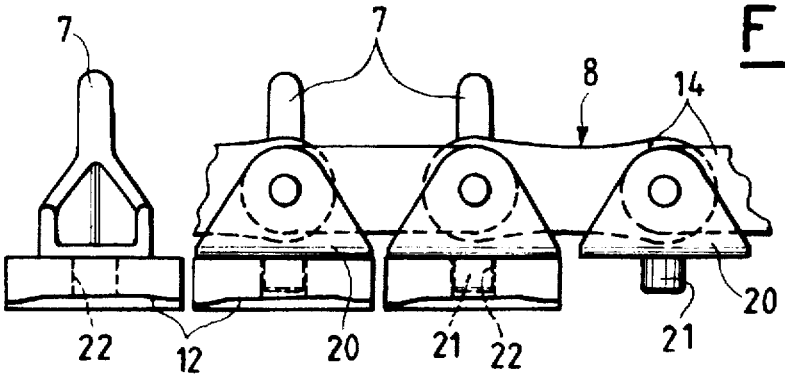
FIG. 3*b* is a fragmentary side elevational view of the system of FIG. 3*a*, and illustrates details thereof.
Figure 3C:
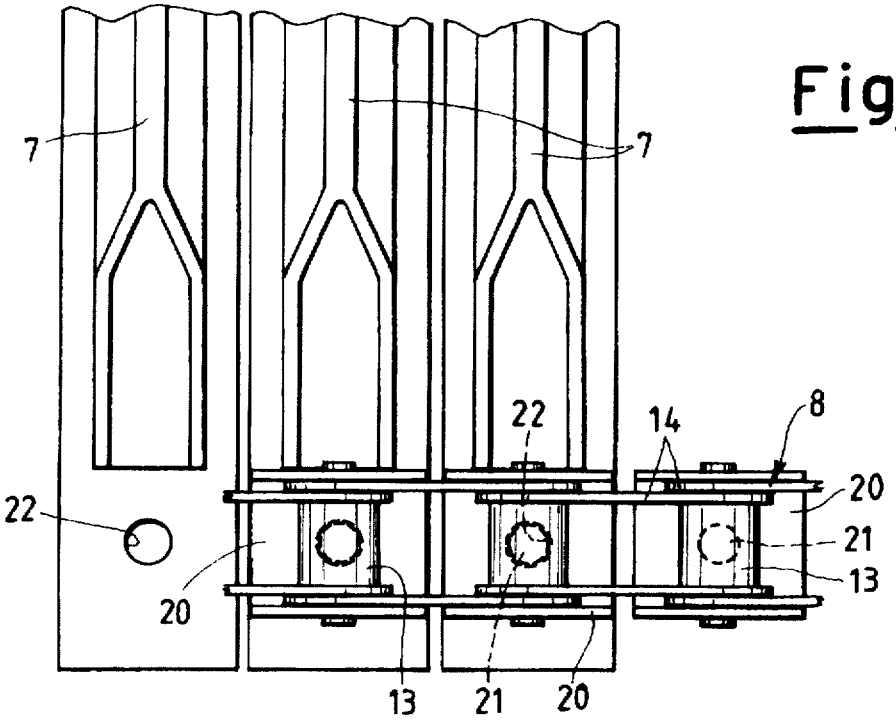
FIG. 3*c* is a fragmentary top plan view of the flat/chain system of FIGS. 3*a* and 3*b*, and illustrates the location of the pegs along a longitudinal axis of the associated chain.

The peg/hole engagements shown in the embodiments of FIGS. 2 and 3 in which the hole is provided in the flat and the peg is provided on the chain element can be reversed without the concept being altered.

Figure 4A:
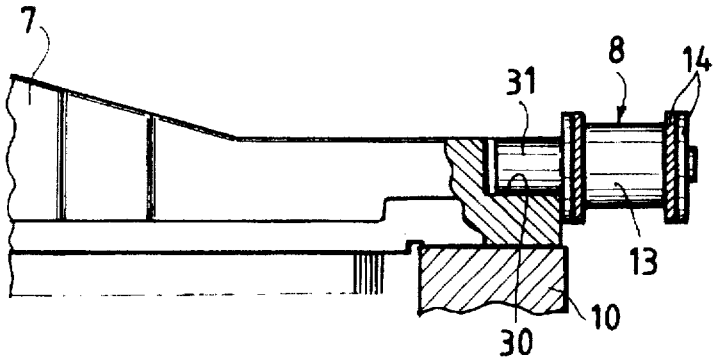
FIG. 4*a* is a fragmentary transverse view through another flat/chain system of the invention, and illustrates pegs carried by pintles of a chain received in an upwardly opening slots of an associated flat.
Figure 4B:
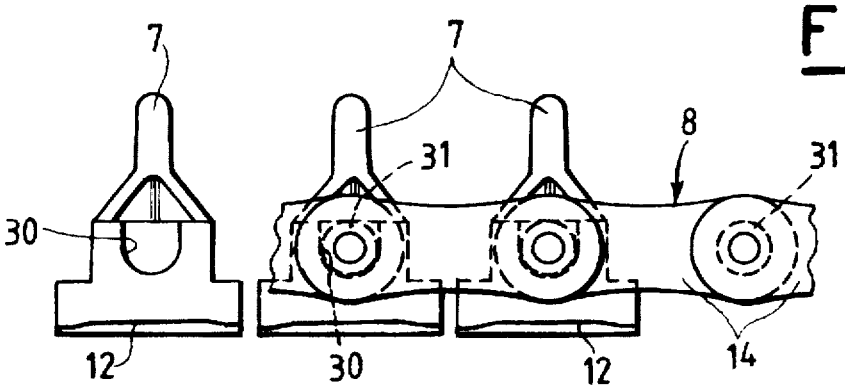
FIGS. 4*b* and 4*c* are respective fragmentary side elevational and fragmentary top plan views of the flat/chain system of FIG. 4*a*, and illustrates details thereof.
Figure 4C:
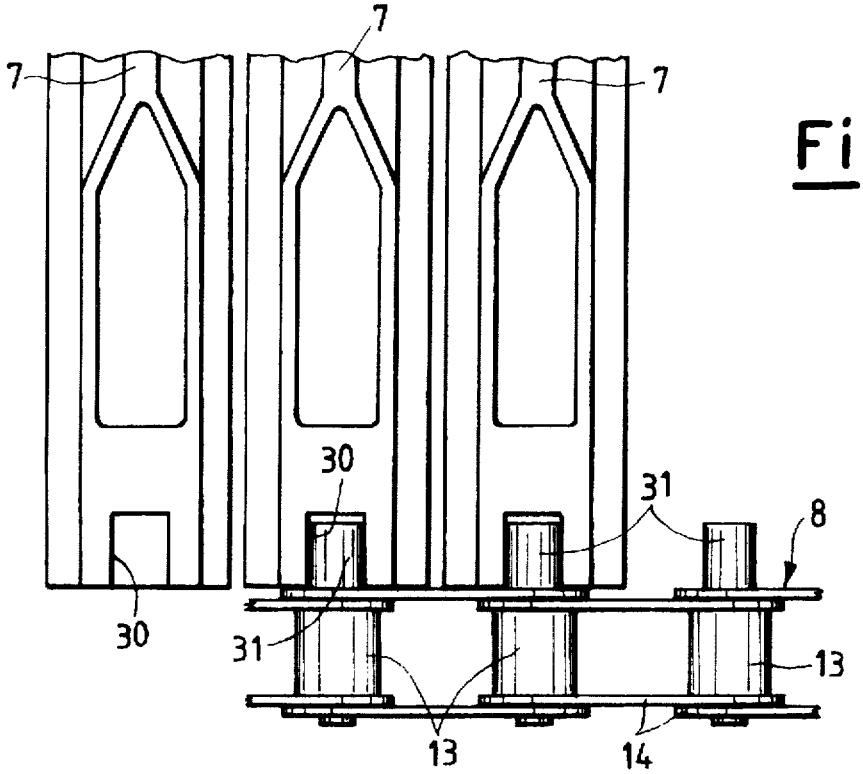

In the embodiment shown in FIGS. 4*a*, *b*, *c* the form fit is obtained by machining in the two ends of each flat 7 a rounded U-shaped cavity with two projections 30. The chains 8 are located external to the flats and carry at each pin 13 of the articulated chain, on that side facing the flats, a peg 31 with its axis parallel to and preferably coincident with the axis of the pin, and intended to fit into their rounded U-shaped cavities formed by the projections 30. Again in this case the fit can be conical or cylindrical, as in the preceding embodiments.

Figure 4D:
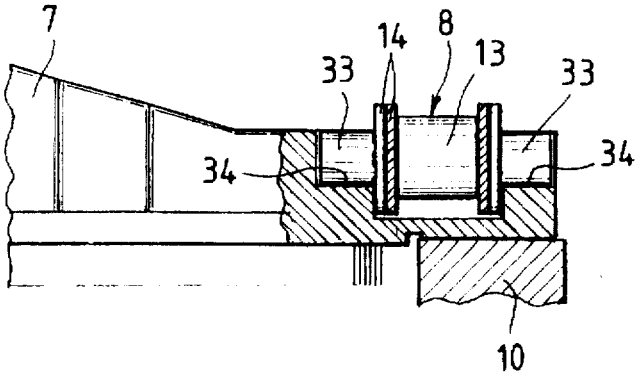
FIG. 4*d* is a transverse view through another flat/chain system of the invention, again with parts broken away for clarity, and illustrates oppositely directed pegs received in upwardly opening slots of an associated flat.
Figure 4E:
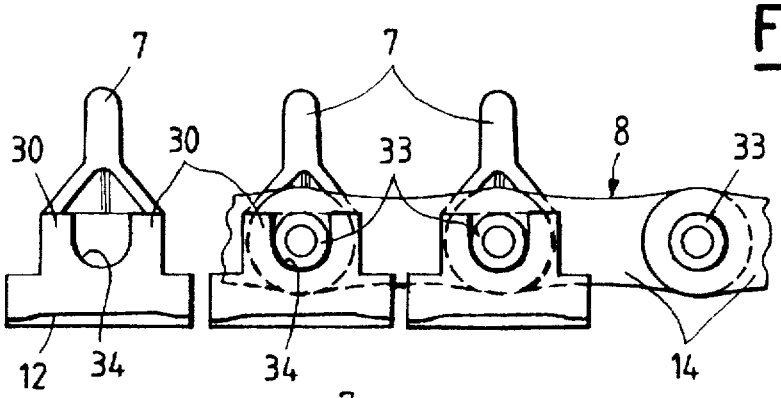
FIGS. 4*e* and 4*f* are respective fragmentary side elevational and fragmentary top plan views of the flat/chain system of FIG. 4*d*, and illustrate details thereof.
Figure 4F:
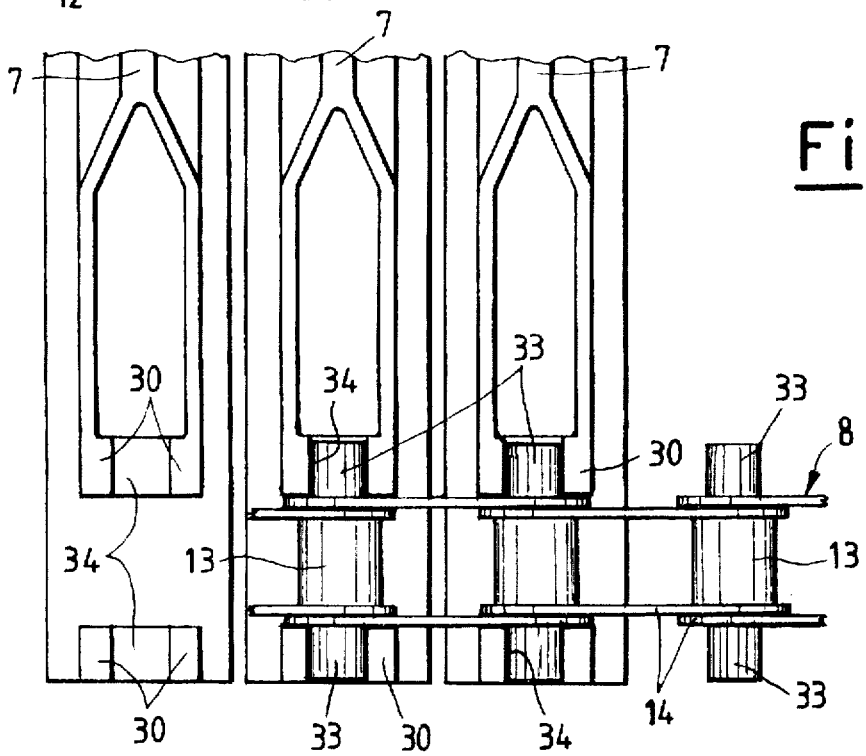
Figure 4G:
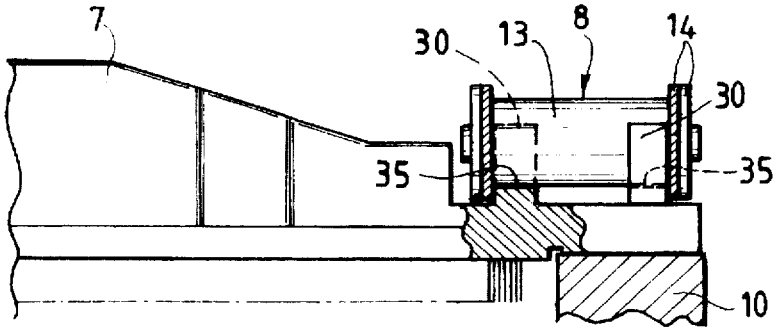
FIG. 4*g* is a transverse view through another flat/chain system, again with parts broken away for clarity, and illustrates a pintle of a chain received in upwardly opening slots of an associated flat.
Figure 4H:
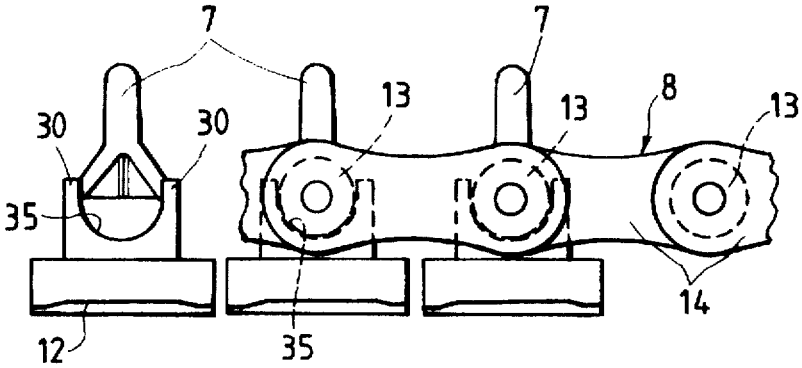
FIGS. 4*h* and 4*i* are respective side elevational and fragmentary top plan views of the flat/chain system of FIG. 4*g*, and illustrates details thereof.
Figure 4I:
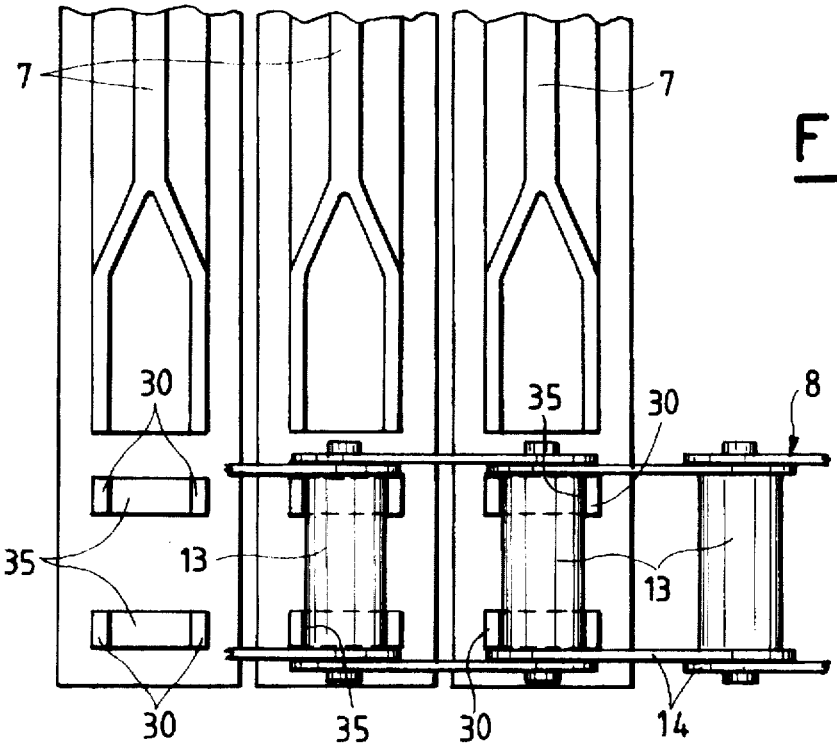

FIGS. 4*d* to 4*i* show two modifications of the coupling system shown in FIGS. 4*a*, *b*, *c*. In FIGS. 4*d*, *e*, *f*, the chain coupling element, corresponding to the peg 31 of the preceding embodiment, consists of two coupling pegs 33 positioned symmetrically on the two ends of the pin 13. Likewise the rounded U-shaped cavity, corresponding to the cavity formed by the projections 30 of the previous embodiment, consists of two coupling cavities 34 positioned symmetrically at the two ends of each pin 13. In FIGS. 4*g*, *h*, *i*, the chain coupling element, corresponding to the peg 31 of the preceding embodiment, consists of the pin 13 itself. Likewise the rounded U-shaped cavities 35, corresponding to the cavity formed by the projections 30 of the preceding embodiment, are positioned within the gap between the two chain plates 14 at the two ends of each pin 13.

Figure 5A:
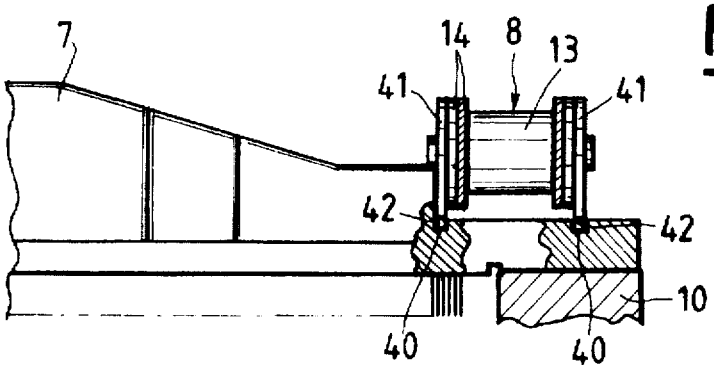
FIG. 5*a* is a transverse cross-sectional view with parts broken away for clarity of another flat/chain system of the present invention, and illustrates chain connectors having polygonal lower edges received in upwardly opening slots of an associated flat.
Figure 5B:
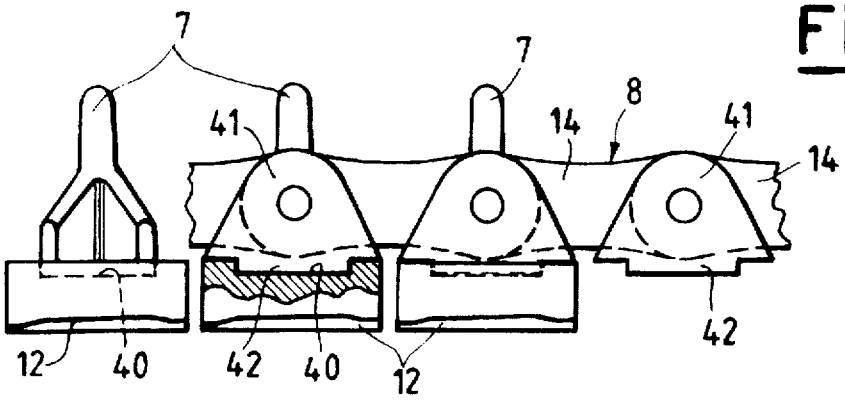
FIGS. 5*b* and 5*c* are respective side elevational and fragmentary top plan views of the flat/chain system of FIG. 5*a*, and illustrate details thereof.
Figure 5C:
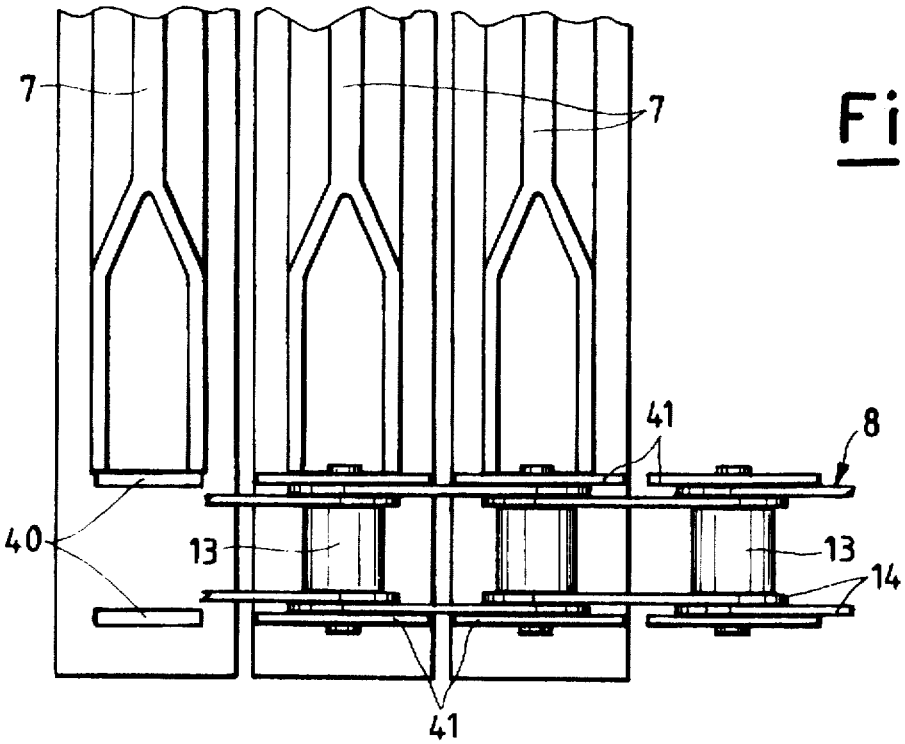

In the embodiment shown in FIGS. 5*a*, *b*, *c*, the form fit is obtained by machining in the two ends of each flat 7 two sharp-edged notches to form prismatic cavities 40. In FIGS. 5*a*, *b*, *c* a sharp-edged U-shaped profile is shown by way of example. The chains 8 carry at the two ends of each pin 13 of the articulated chain a pair of triangular elements 41 the bottom of which carries a sharp-edged projection 42 on the side facing the flats and which is intended to fit into the correspondingly shaped prismatic cavities formed by the sharp-edged notches 40.

Figure 5D:
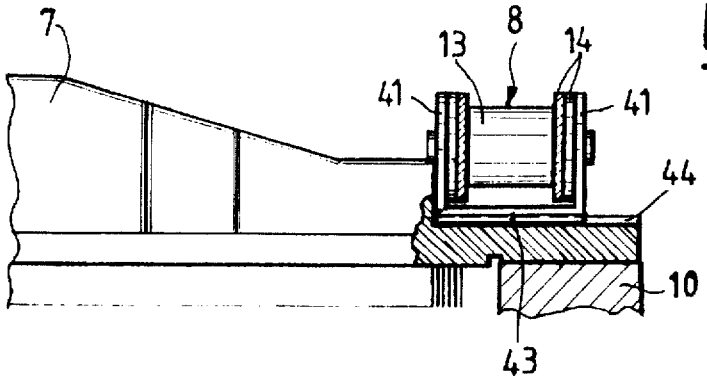
FIG. 5*d* is a transverse view through another flat/chain system of the invention, and illustrates a lower edge of a bracket of a chain received in an upwardly opening slot of an associated frame.
Figure 5E:
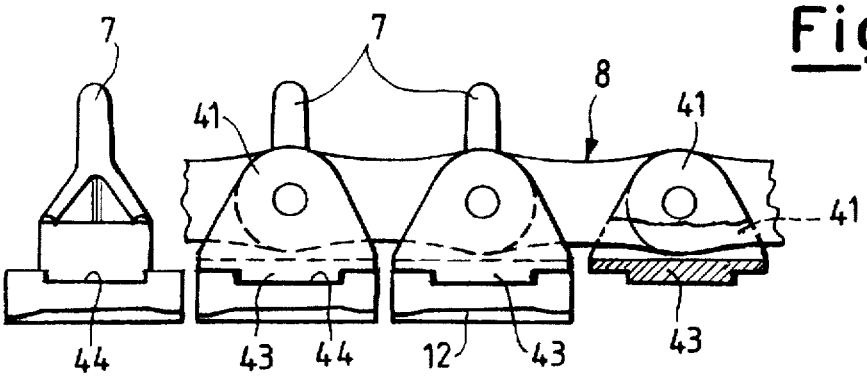
FIGS. 5*e* and 5*f* are respective fragmentary side elevational and fragmentary top plan views of the flat/chain system of FIG. 5*d*, and illustrate the details thereof.
Figure 5F:
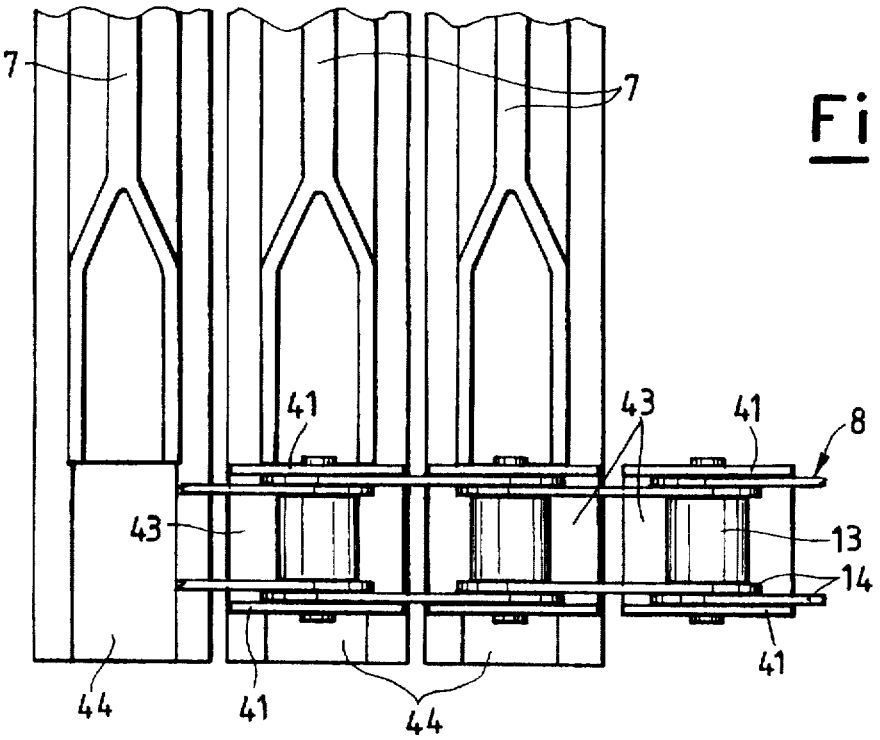

FIGS. 5*d*, *e*, *f* show a modification of the coupling system shown in FIGS. 5*a*, *b*, *c*. In FIGS. 5*d*, *e*, *f*, the chain coupling element, corresponding to the two projections 42 of the triangular elements 41 of the preceding embodiment, consists of a sharp-edged prismatic element 43 which joins together the two triangles 41 positioned symmetrically at the two ends of each pin 13. Likewise the sharp-edged cavity 44 for receiving the element 43, and corresponding to the cavity 40 of the preceding embodiment, extends towards the ends of the flat 7 and has a shape consistent with that of the prismatic end 43 which it is to receive.

As can be seen, the embodiments shown in FIGS. 4 and 5 differ from each other in that the embodiment of FIG. 4 enables the peg 31, and the pin 13, to rotate freely within its receiving cavity in the flat about the pin axis, whereas the embodiment of FIG. 5 does not allow the prismatic projections to rotate within the prismatic cavities which receive them.

Figure 6A:
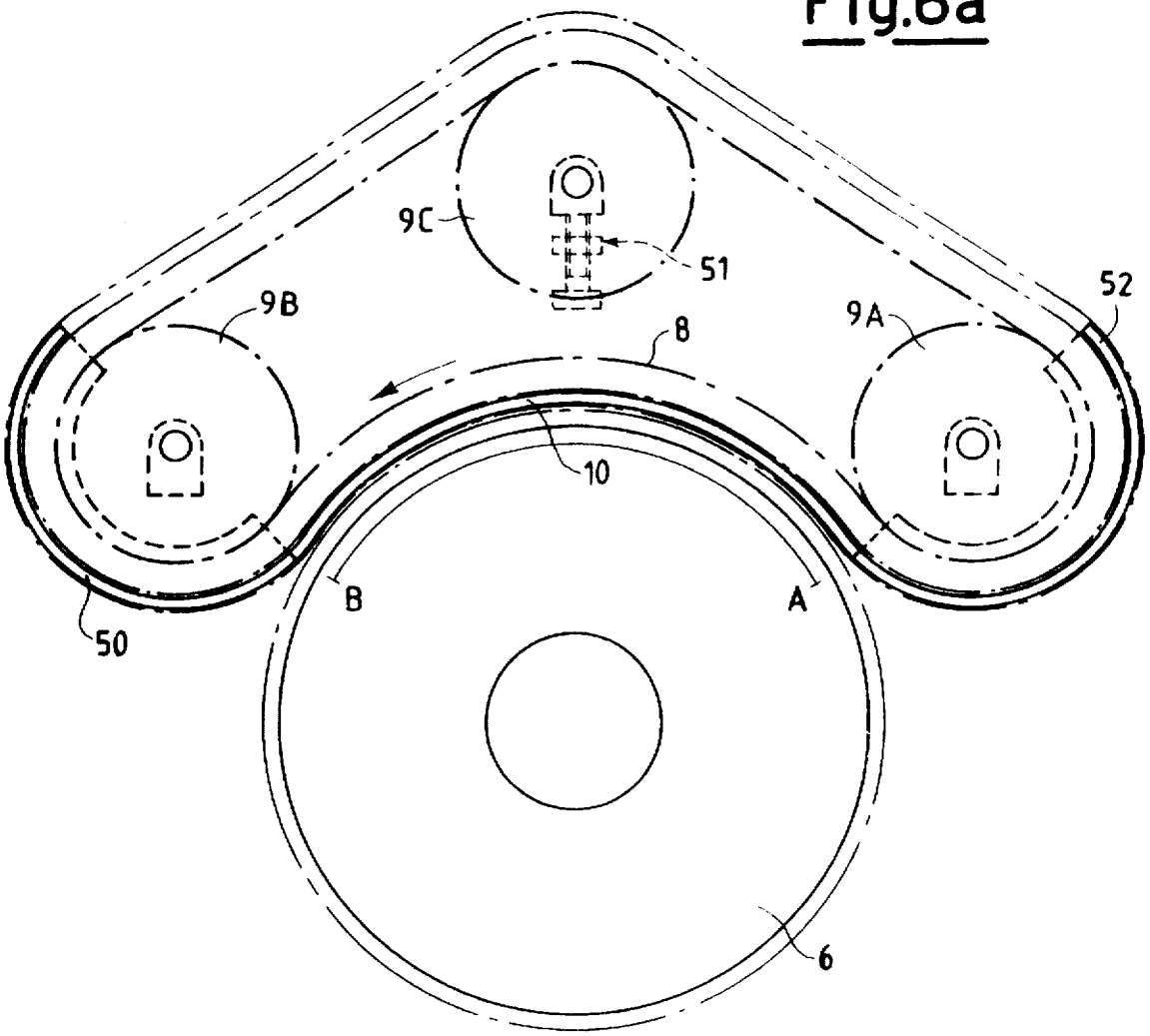
FIG. 6*a* is a highly schematic side elevational view of a drive for any one of the flat/chain systems of the invention, and illustrates guides for retaining flats associated with drive chains during movement thereof along lower runs of the drive chains.
Figure 6B:
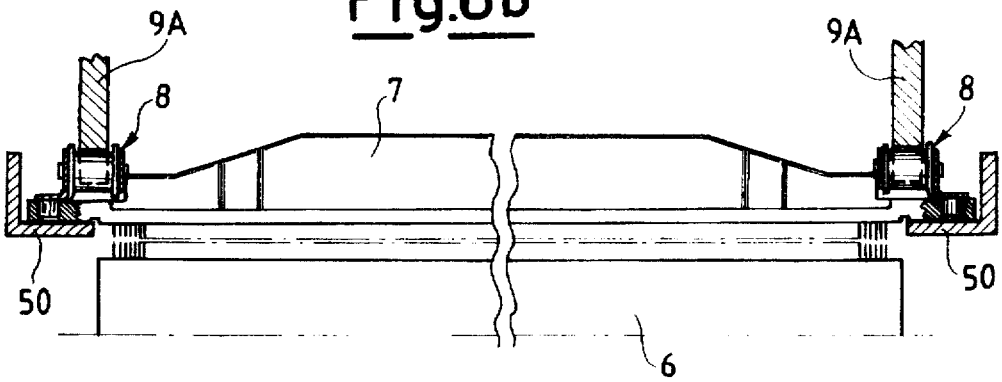
FIG. 6*b* is a fragmentary transverse cross-sectional view through the flat/chain system of FIG. 6*a*, and illustrates one of the flats supported and guided by the guides.

FIG. 6 shows an example of the drive for the flat/chain system according to the invention. Along the path AB and guided by the guide 10, which has another corresponding guide 10 of parallel axis on the other side of the drum, the series of flats 7 is driven by the articulated chains 8 which follow the path defined by the sprockets 9, of which at least one is motorized and at least one is provided with chain tensioning members. As in the case of the guides 10, the sprockets are in the form of pairs of corresponding sprockets, one for each side of the drum 6. Where the paths of the drum and flats separate at B, the guides 10 are connected to a semicircular portion 50 of L cross-section which prevents the series of flats, connected to the chains 8 while they pass about the sprockets 9B, from separating from them by the effect of gravity and the freedom which they possess in the direction perpendicular to the chain movement. When direction reversal is complete after passage about 9B, the flats simply rest on the chains along the path between 9B and 9A, with no danger of falling. An adjustable chain tensioner 51 is shown schematically at the sprocket 9C.

On reaching the sprockets 9A the problem of movement direction reversal of the chain 8 and the problem of maintaining the flats 7 connected to the chain again arise. For this purpose the guides 10 are connected to another semicircular portion 52 of L cross-section which prevents the series of flats, connected to the chains 8 while they pass about the sprockets 9A, from separating from them by the effect of gravity and the freedom which they possess in the direction perpendicular to the chain movement. When direction reversal is complete after passage about 9A, the flats are again controlled by the guides 10 along the path between 9A and 9B, with no danger of falling.

Along the path from A to B the chains rest on the flats, which in their turn rest continually on the guides 10. Along the path from B to A the flats rest on the chains 8, which are supported only about the sprockets 9A, 9C and 9B.

One of the great advantages of the present invention is the fact that during their non-working upper travel from 9B to 9A the flats 7 simply rest on the pair of chains 8.

In this respect it should be noted that during carding, the material is such that the cylinders and flats require frequent cleaning and clothing replacement.

In consideration of such operations and the large number of flats, of the order of one hundred, installed on the machine, it is advantageous to be able to remove and replace a flat by simply raising it from its location in the pair of chains 8 during the upper part of its path. In devices of the known art the flats are generally removed from the chains and replaced by removing at least two screws per flat, whereas in the present case the flat is withdrawn without having to remove any fixings. If no particular safety regulations exist, the flats can also be removed while they are in movement, given their low peripheral speed and the instantaneousness of their removal. The absence of fixings between the chain and flat in the direction perpendicular to the chain movement enables the flats to follow the profile of the guides 10 with extreme accuracy. The construction, installation and maintenance of the flat/chain system are simpler and less costly.

For completeness it should be noted that in the aforegoing description reference has been made to embodiments in which the chains and flats have the same pitch, ie the beginning of each element is the same distance from the beginning of the next element in the plane of the figure, or in other words one flat corresponds to each chain link. The present invention can also be usefully applied where the element dimensions are not the same but instead one is a multiple of the other. An example is the case in which two chain links correspond with one flat, ie the flats have double the pitch of the chain. In this case the connection between the chains and flats has to be made at every two chain links.

What is claimed is:

1. A sliding flats system for a carding machine comprising a conveyor mechanism defining upper and lower flights which travel in substantially opposite relative directions, a drum having a circumferential surface portion disposed in adjacent spaced relationship to said lower flight, said lower flight defining a path of travel corresponding to said circumferential surface portion, a plurality of substantially side-by-side flats moved by said conveyor mechanism along said upper and lower flights, said flats resting substantially freely upon and vertically unrestrained relative to said upper flight during movement therewith, guide means for supporting and restraining said flats against substantial downward vertical movement relative to said lower flight during movement therewith, means for coupling said conveyor mechanism to said flats, said coupling means including a plurality of L-shaped members of said conveyor mechanism each carrying a peg, and a hole in each flat receiving an associated peg.

2. The sliding flats system as defined in claim 1 wherein said conveyor mechanism includes a pair of chains each defined by a plurality of links, and said links carry said L-shaped members.

3. The sliding flats system as defined in claim 1 wherein said conveyor mechanism includes a pair of chains each defined by a plurality of links, and said links carry said L-shaped members laterally outboard of the links.

4. A sliding flats system for a carding machine comprising a conveyor mechanism defining upper and lower flights which travel in substantially opposite relative directions, a drum having a circumferential surface portion disposed in adjacent spaced relationship to said lower flight, said lower flight defining a path of travel corresponding to said circumferential surface portion, a plurality of substantially side-by-side flats moved by said conveyor mechanism along said upper and lower flights, said flats resting substantially freely upon and vertically unrestrained relative to said upper flight during movement therewith, guide means for supporting and restraining said flats against substantial downward vertical movement relative to said lower flight during movement therewith, means for coupling said conveyor mechanism to said flats, said coupling means including a plurality of U-shaped elements of said conveyor mechanism each carrying a peg, and a hole in each flat receiving an associated peg.

5. The sliding flats system as defined in claim 4 wherein said conveyor mechanism includes a pair of chains each defined by a plurality of links, and said links carry said U-shaped elements.

6. A sliding flats system for a carding machine comprising a conveyor mechanism defining upper and lower flights which travel in substantially opposite relative directions, a drum having a circumferential surface portion disposed in adjacent spaced relationship to said lower flight, said lower flight defining a path of travel corresponding to said circumferential surface portion, a plurality of substantially side-by-side flats moved by said conveyor mechanism along said upper and lower flights, said flats resting substantially freely upon and vertically unrestrained relative to said upper flight during movement therewith, guide means for supporting and restraining said flats against substantial downward vertical movement relative to said lower flight during movement therewith, means for coupling said conveyor mechanism to said flats, said coupling means including a plurality of U-shaped elements of said conveyor mechanism each defined by a pair of spaced generally parallel legs and a bight portion therebetween, said bight portion defining a projection, and a cavity in each flat receiving an associated projection.

7. The sliding flats system as defined in claim 6 wherein said conveyor mechanism includes a pair of chains each defined by a plurality of links, and said links carry said U-shaped elements.

8. A sliding flats system for a carding machine comprising a conveyor mechanism defining upper and lower flights which travel in substantially opposite relative directions, a drum having a circumferential surface portion disposed in adjacent spaced relationship to said lower flight, said lower flight defining a path of travel corresponding to said circumferential surface portion, a plurality of substantially side-by-side flats moved by said conveyor mechanism along said upper and lower flights, said flats resting substantially freely upon and vertically unrestrained relative to said upper flight during movement therewith, guide means for supporting and restraining said flats against substantial downward vertical movement relative to said lower flight during movement therewith, means for coupling said conveyor mechanism to said flats, said coupling means including a plurality of U-shaped elements of said conveyor mechanism each defined by a pair of spaced generally parallel legs and a bight portion therebetween, said bight portion defining a projection, a cavity in each flat receiving an associated projection, and said projections and cavities are of substantially complementary shape and size.

9. The sliding flats system as defined in claim 8 wherein said conveyor mechanism includes a pair of chains each defined by a plurality of links, and said links carry said U-shaped elements.

10. A sliding flats system for a carding machine comprising a conveyor mechanism defining upper and lower flights which travel in substantially opposite relative directions, a drum having a circumferential surface portion disposed in adjacent spaced relationship to said lower flight, said lower flight defining a path of travel corresponding to said circumferential surface portion, a plurality of substantially side-by-side flats moved by said conveyor mechanism along said upper and lower flights, said flats resting substantially freely upon and vertically unrestrained relative to said upper flight during movement therewith, guide means for supporting and restraining said flats against substantial downward vertical movement relative to said lower flight during movement therewith, means for coupling said conveyor mechanism to said flats, said coupling means include a plurality of pins of said conveyor mechanism having substantially horizontally disposed axes, and a cavity in each flat opening upwardly along said lower flight and downwardly along said upper flight receiving an associated pin.

11. The sliding flats system as defined in claim 10 wherein said conveyor mechanism includes a pair of chains each defined by a plurality of links interconnected by said plurality of pins.

12. A sliding flats system for a carding machine comprising a conveyor mechanism defining upper and lower flights which travel in substantially opposite relative directions, a drum having a circumferential surface portion disposed in adjacent spaced relationship to said lower flight, said lower flight defining a path of travel corresponding to said circumferential surface portion, a plurality of substantially side-by-side flats moved by said conveyor mechanism along said upper and lower flights, said flats resting substantially freely upon and vertically unrestrained relative to said upper flight during movement therewith, guide means for supporting and restraining said flats against substantial downward vertical movement relative to said lower flight during movement therewith, means for coupling said conveyor mechanism to said flats, said coupling means include a plurality of pins of said conveyor mechanism having substantially horizontally disposed axes, and a substantially U-shaped cavity in each flat opening upwardly along said lower flight and downwardly along said upper flight receiving an associated pin.

13. The sliding flats system as defined in claim 12 wherein said conveyor mechanism includes a pair of chains each defined by a plurality of links interconnected by said plurality of pins.

* * * * *